US005104010A

United States Patent [19]

Codorniz et al.

[11] Patent Number: 5,104,010

[45] Date of Patent: Apr. 14, 1992

[54] CONTAINER POURING APPARATUS

[76] Inventors: Paul J. Codorniz; MaryJane Codorniz, both of 17993 Road 96, Tulare, Calif. 93274

[21] Appl. No.: 693,148

[22] Filed: Apr. 29, 1991

[51] Int. Cl.[5] ..... A47G 19/00

[52] U.S. Cl. ..... 222/475; 222/479

[58] Field of Search ..... 222/475, 479, 468, 478; 215/100 A, 243, 11.5; 294/27.1

[56] References Cited

U.S. PATENT DOCUMENTS

| | | | |
|---|---|---|---|
| 830,442 | 9/1906 | Epperson | 222/468 |
| 3,217,948 | 11/1965 | Mullen | 222/468 X |
| 3,400,865 | 9/1968 | Hester | 222/475 |
| 3,506,167 | 4/1970 | Orr | 222/479 |
| 4,838,464 | 6/1989 | Briggs | 222/478 |
| 4,865,208 | 9/1989 | Lax et al. | 215/100 A |
| 4,932,544 | 6/1990 | Glazer | 222/475 X |

*Primary Examiner*—Kevin P. Shaver
*Assistant Examiner*—Gregory L. Huson
*Attorney, Agent, or Firm*—Leon Gilden

[57] ABSTRACT

A container pouring apparatus is provided, wherein a container support member includes an oval conical portion mounted to an upper cylindrical portion receiving a container therewithin, with an air supply mounted within the upper cylindrical portion directed through the lower conical portion adjacent a fixedly mounted handle to direct air into a container to equalize pressure within the container for fluid flow therefrom.

2 Claims, 3 Drawing Sheets

CONTAINER POURING APPARATUS

BACKGROUND OF THE INVENTION

1. Field of the Invention

The field of invention relates to pouring devices, and more particularly pertains to a new and improved container pouring apparatus wherein the same is arranged to equalize pressure within a container during flow of fluid from the container.

2. Description of the Prior Art

Various pouring devices have been utilized in the prior art to enhance pouring from within a container. However, devices of the prior art have not heretofore utilized a conduit as set forth by the instant invention to direct and equalize air pressure therewithin. Examples of prior art are typically of a straw-type configuration as exemplified in U.S. Pat. No. 4,607,755 to Andreozzi wherein a cup member utilizes a straw that is directed through the cup member and projects above the cup member.

Similarly, U.S. Pat. No. 4,043,478 to Duncan sets forth a beverage container with a straw projecting above the container.

U.S. Pat. No. 4,830,204 to Lin, U.S. Pat. No. 4,826,034 to Forbes, and U.S. Pat. No. 4,911,315 to Shrum set forth each a beverage container with a projecting straw directed therefrom.

As such, it may be appreciated that there continues to be a need for a new and improved container pouring apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of container apparatus now present in the prior art, the present invention provides a container pouring apparatus wherein the same utilizes a pressure equalizing straw directed into the container to enhance and effect fluid flow therefrom. As such, the general purpose of the present invention, which will be described subsequently in greater detail, is to provide a new and improved container pouring apparatus which has all the advantages of the prior art container apparatus and none of the disadvantages.

To attain this, the present invention provides a container pouring apparatus wherein a container support member includes an oval conical portion mounted to an upper cylindrical portion receiving a container therewithin, with an air supply mounted within the upper cylindrical portion directed through the lower conical portion adjacent a fixedly mounted handle to direct air into a container to equalize pressure within the container for fluid flow therefrom.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container pouring apparatus which has all the advantages of the prior art container apparatus and none of the disadvantages.

It is another object of the present invention to provide a new and improved container pouring apparatus which may be easily and efficiently manufactured and marketed.

It is a further object of the present invention to provide a new and improved container pouring apparatus which is of a durable and reliable construction.

An even further object of the present invention is to provide a new and improved container pouring apparatus which is susceptible of a low cost of manufacture with regard to both materials and labor, and which accordingly is then susceptible of low prices of sale to the consuming public, thereby making such container pouring apparatus economically available to the buying public.

Still yet another object of the present invention is to provide a new and improved container pouring apparatus which provides in the apparatuses and methods of the prior art some of the advantages thereof, while simultaneously overcoming some of the disadvantages normally associated therewith.

Still another object of the present invention is to provide a new and improved container pouring apparatus wherein the same is arranged for effecting fluid flow from within a container during a pouring procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
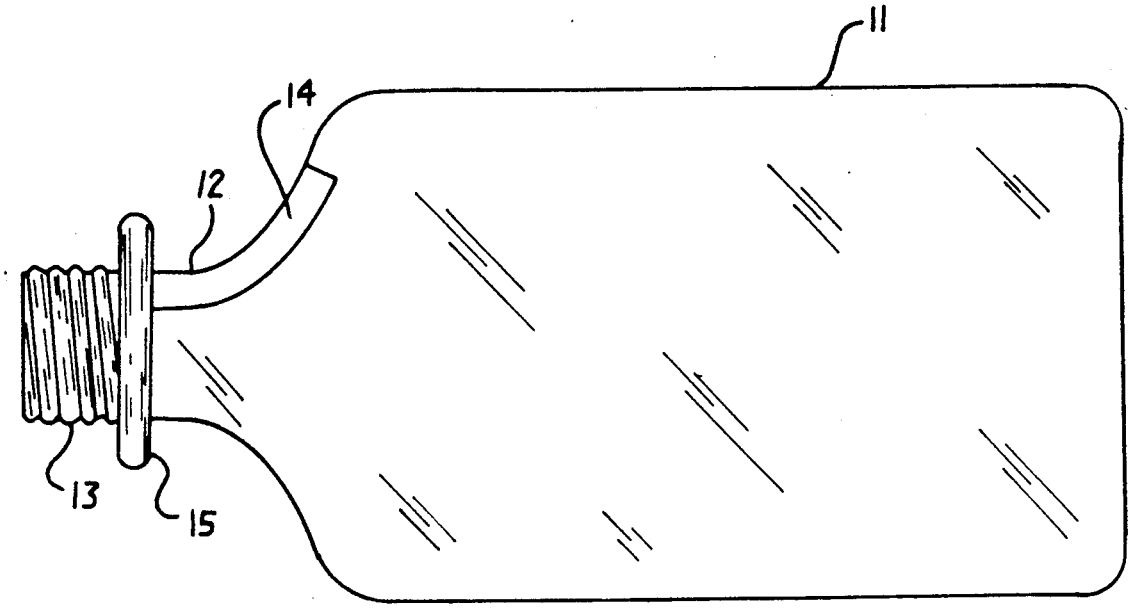
FIG. 1 is an orthographic side view of the container utilizing an equalizing pressure conduit, as set forth by the instant invention.
Figure 2:
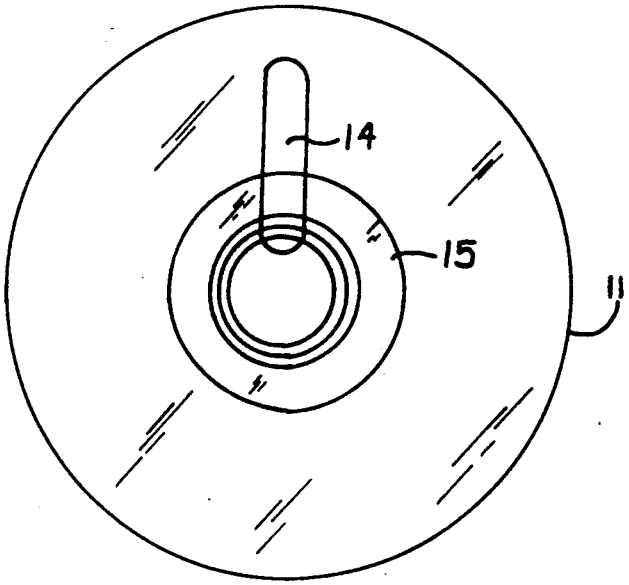
FIG. 2 is an orthographic frontal view, taken in elevation, of the container as set forth in FIG. 1.

With reference now to the drawings, and in particular to FIGS. 1 to 5 thereof, a new and improved container pouring apparatus embodying the principles and concepts of the present invention and generally designated by the reference numeral 10 will be described.

More specifically, the container pouring apparatus 10 of the instant invention essentially comprises a container body 11 that includes a pouring neck 12. The container body 11 is defined by a first diameter, and the pouring neck 12 is defined by a second diameter less than the first diameter. The pouring neck 12 includes a threaded peripheral exterior surface. An air supply conduit 14 is mounted with an interior surface of the pouring neck 12 whose upper terminal end is aligned with the upper terminal end of the pouring neck 12. An abutment flange 15 is mounted coaxially relative to a lower terminal end of the threaded peripheral external surface 13.

Figure 3:
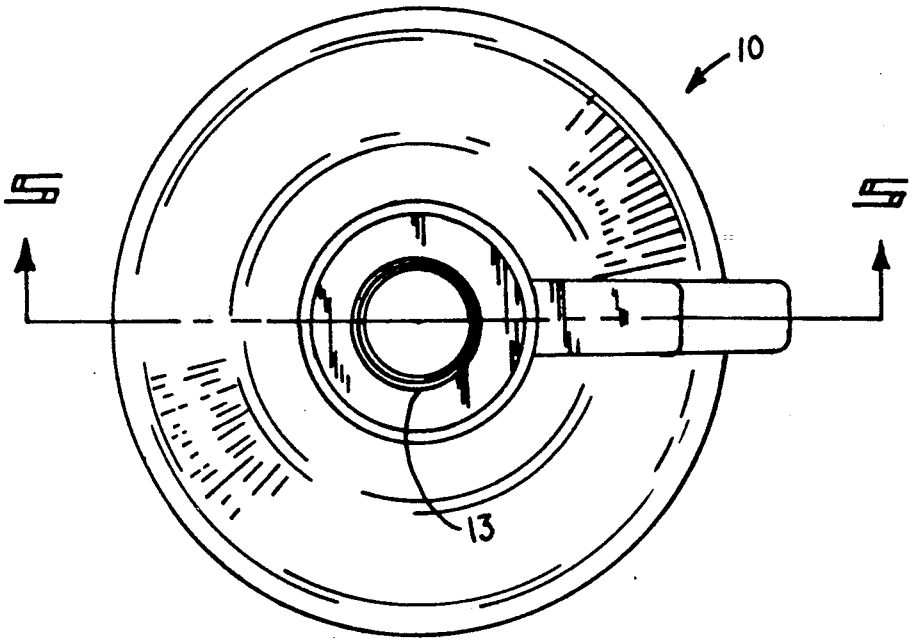
FIG. 3 is an orthographic top view of a further example of a prior art container mounting head.
Figure 4:
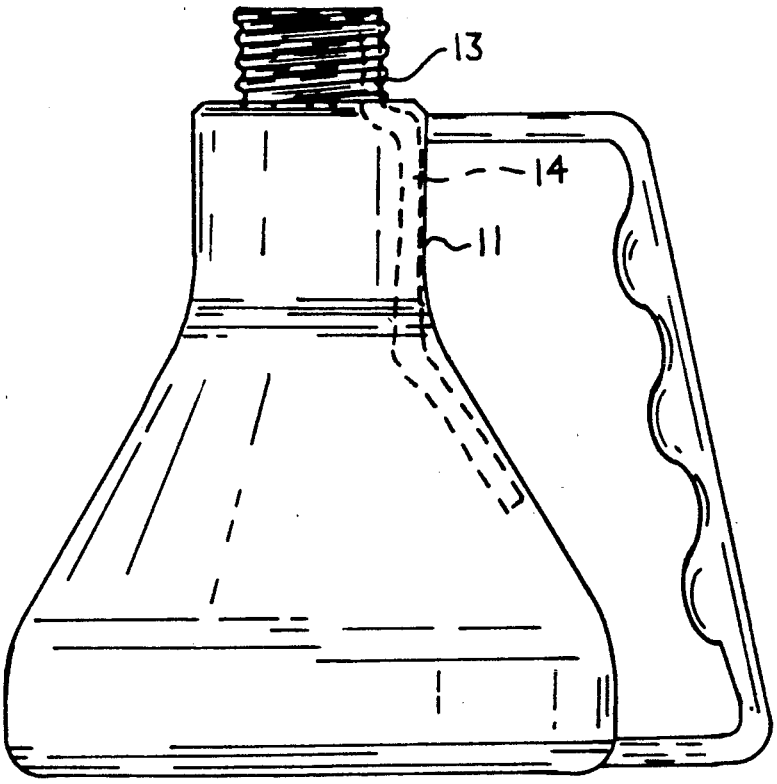
FIG. 4 is an orthographic side view of the invention as illustrated in FIG. 3.
Figure 5:
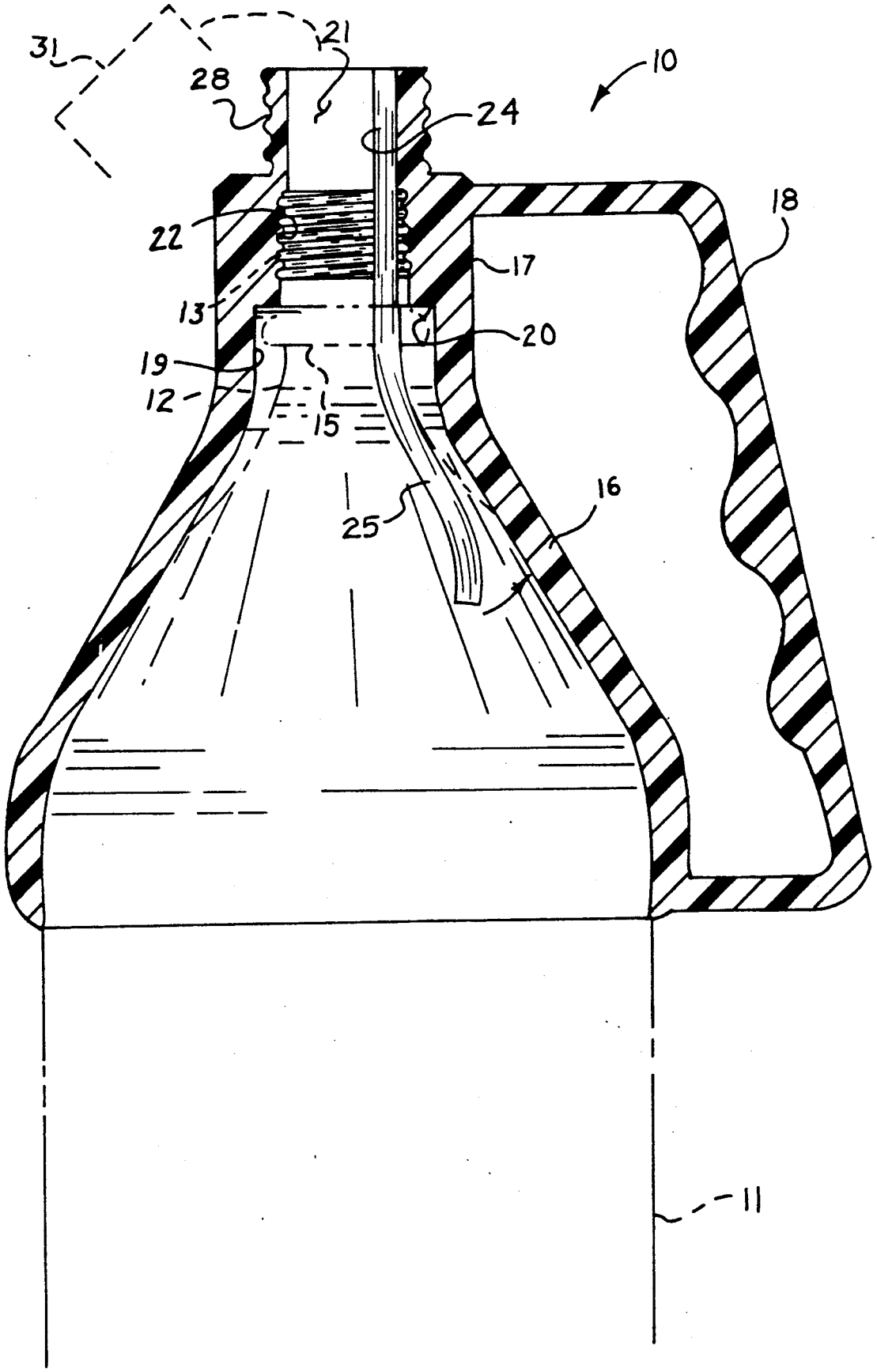
FIG. 5 is an orthographic side view of the invention, taken along the lines 5—5 of FIG. 3 in the direction indicated by the arrows.

FIGS. 3-5 illustrate the container pouring apparatus 10 wherein a conical skirt 16 includes a cylindrical collar 17 coaxially and integrally mounted to an upper terminal end of the conical skirt 16. A handle loop 18 extends from an upper terminal end of the cylindrical collar 17 downwardly to a lower terminal end of the handle loop 18, wherein the container body 11 absent the air supply conduit 14 is received within the conical skirt 16. The cylindrical 17 includes a first cylindrical cavity 19 directed through a lower terminal end of the cylindrical collar 17 and includes a surface 20 of a generally torroidal configuration. The abutment surface 20 receives an abutment flange 15 of the container body 11 and accordingly is defined by a surface diameter substantially equal to the abutment flange diameter of the abutment flange 15. The cylindrical collar 17 includes a cylindrical bore 21 directed therethrough, coaxially aligned with the first cylindrical cavity 19 and the conical skirt 16. The cylindrical bore 21 includes an internally threaded lower cylindrical wall 22 to threadedly receive the threaded peripheral external surface 13 of the pouring neck 12. Further, an internal smooth upper cylindrical wall 23 projects from the internally threaded lower cylindrical wall 22 to an upper terminal end of the cylindrical collar 17 An air supply conduit 24 is fixedly mounted to the internal smooth upper cylindrical wall 23 adjacent with the handle 18 and is fixedly mounted to the upper cylindrical wall 23 axially parallel to the axis of the cylindrical bore 21. A lower end portion 25 of the air supply conduit 24 is biased against an interior wall of the conical skirt 16 and spaced below the abutment surface 20 to position medially of the conical skirt 16. The cylindrical collar 17 includes an externally threaded boss 28 projecting above the handle 18 and coaxially aligned with the cylindrical collar 17 to threadedly receive a cap member 31 thereon to provide permanent securement of the apparatus 10 to the container body 11 during use.

It should be noted that the lower end portion 25 of the air supply conduit 24 extending medially of the conical surface 16 does so as measured along an axial height of the conical skirt 16 to ensure positioning of the lower terminal end of the lower end portion of the air supply conduit 24 to position interiorly of the container body 11 to ensure directing of an air supply therewithin upon a minimum of fluid being poured from the container body during use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container pouring apparatus, comprising in combination, a container body, the container body defined by a cylindrical configuration of a first diameter, the container body including a pouring neck coaxially aligned with the container body defined by a second diameter less than the first diameter, the pouring neck defined by a threaded peripheral external surface, and an abutment flange fixedly mounted to the pouring neck extending radially beyond the pouring neck and coaxially aligned with the pouring neck mounted to a lower terminal end of the pouring neck adjacent the threaded peripheral external surface, and a conical skirt means mounted to the container body in surrounding relationship relative to the container body receiving a threaded peripheral external surface of the pouring neck therewithin, wherein the conical skirt means includes an air supply conduit mounted within the conical skirt means for projection within the pouring neck to direct air into the container body equalizing pressure therewithin during a fluid pouring procedure from the container body, and wherein the conical skirt means includes a conical skirt, the conical skirt including a cylindrical collar fixedly mounted to an upper terminal end of the conical skirt, wherein the conical skirt and cylindrical collar are coaxially aligned, and a handle loop, the handle loop mounted at a lower terminal end of the handle loop to a lower terminal end of the conical skirt, and an upper terminal end of the handle loop mounted to an upper terminal end of the cylindrical collar, and the cylindrical collar including a first cylindrical cavity, the first cylindrical cavity including an abutment surface projecting radially beyond the first cylindrical cavity, the abutment surface defined by an abutment surface diameter and the abutment flange defined by an equal abutment surface diameter to receive the abutment flange thereon in securement of the container body to the conical skirt means.

2. An apparatus as set forth in claim 1 wherein the cylindrical collar includes a cylindrical bore coaxially directed therethrough, wherein the cylindrical bore includes an internally threaded lower cylindrical wall threadedly receiving the threaded peripheral external surface of the pouring neck therewithin, and an internally smooth upper cylindrical wall extending above the internally threaded lower cylindrical wall, and an externally threaded boss coaxially aligned with the cylindrical collar fixedly mounted to the cylindrical collar projecting above the handle loop, with the externally threaded boss including a cap member threadedly securable to the externally threaded boss above the handle loop, and the air supply conduit is fixedly mounted to the interior smooth upper cylindrical wall adjacent the handle loop, and a lower end portion of the air supply conduit extends below the abutment surface and interiorly of the container body, wherein the lower portion of the air supply conduit is biased against an interior wall of the conical skirt and extends to position medially of an axial height defined by the conical skirt.

* * * * *